US008955447B1

(12) United States Patent
Miksch

(10) Patent No.: US 8,955,447 B1
(45) Date of Patent: Feb. 17, 2015

(54) METHOD FOR JOINING FABRIC

(76) Inventor: Linda Susan Miksch, Normandy Park, WA (US)

( * ) Notice: Subject to any disclaimer, the term of this patent is extended or adjusted under 35 U.S.C. 154(b) by 362 days.

(21) Appl. No.: 13/506,147

(22) Filed: Mar. 30, 2012

Related U.S. Application Data

(60) Provisional application No. 61/516,108, filed on Mar. 30, 2011.

(51) Int. Cl.
*D05C 5/02* (2006.01)

(52) U.S. Cl.
USPC ..... 112/475.19

(58) Field of Classification Search
USPC ..... 112/475.18, 475.19, 102.5, 112/470.01–470.06
See application file for complete search history.

(56) References Cited

U.S. PATENT DOCUMENTS

| | | | | |
|---|---|---|---|---|
| 5,791,062 | A | 8/1998 | Walker | |
| 6,370,442 | B1 * | 4/2002 | Wang | 700/138 |
| 6,944,963 | B2 | 9/2005 | Amaru | |
| 7,089,079 | B2 * | 8/2006 | Kaiya et al. | 700/136 |
| 7,281,337 | B1 | 10/2007 | Oehlke et al. | |
| 7,383,640 | B2 | 6/2008 | Barry | |
| 7,814,851 | B2 * | 10/2010 | Tashiro | 112/470.01 |
| 7,946,042 | B2 | 5/2011 | Williams | |
| 8,022,307 | B2 * | 9/2011 | Chu et al. | 174/254 |
| 8,176,861 | B2 * | 5/2012 | Hayakawa et al. | 112/470.01 |
| 8,683,932 | B2 * | 4/2014 | Eklund et al. | 112/475.19 |
| 2011/0005441 | A1 | 1/2011 | Roche | |

OTHER PUBLICATIONS

"Curvemaster Presser Foot Tutorial". Available at: http://siterepository.s3.amazonaws.com/00311201003061141458535.pdf. Downloaded Mar. 17, 2012.

"Accuquilt GO! Fabric Cutter" representative material. Available at: http://www.accuquilt.com/fabric-cutter-comparison. Downloaded Mar. 25, 2012.

* cited by examiner

*Primary Examiner* — Tejash Patel

(57) ABSTRACT

Provided are improved methods for joining two pieces of fabric along a seam (e.g., curved seam) to form a fabric pattern piece (e.g., quilting block unit) using an embroidery machine. A digitized file instructs an embroidery machine to stitch a perforated guide-line in a stabilizer material secured inside an embroidery hoop for forming an opening having a desired shape in the stabilizing material. A first fabric is temporarily affixed to one side of the stabilizer material, and an opening with a seam allowance margin is cut in the fabric along the desired seam defined by the opening/shape in the stabilizing material. The seam allowance margin is folded through the opening/shape to the reverse side, and a second piece of fabric is affixed to the folded margin. The digitized file instructs the machine to stitch a hidden seam along the desired seam providing esthetic, geometrically precise fabric pattern pieces.

19 Claims, 6 Drawing Sheets

METHOD FOR JOINING FABRIC

FIELD OF THE INVENTION

Aspects relate generally to methods for joining fabric, and in more particular aspects to sewing and quilting and methods for joining fabric with curved seams, including computer-implemented (e.g., using software-driven sewing and embroidery machines, and the like) methods for joining fabric with curved seams.

CROSS-REFERENCE TO RELATED APPLICATIONS

This application claims the benefit of U.S. Provisional Patent Application Ser. No. 61/516,108, filed 30 Mar. 2012, which is incorporated herein by reference in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The following is a tabulation of some prior art that presently appears relevant:

U.S. patents

| Pat. No. | Issue Date | Patentee |
|---|---|---|
| 5,791,062 | Aug. 8, 1998 | Walker |
| 6,944,963 | Sep. 20, 2005 | Amaru |
| 7,281,337 | Oct. 16, 2007 | Oehlke & Moen |
| 7,383,640 | Jun. 10, 2008 | Barry |
| 7,946,042 | May 24, 2011 | Williams |

U.S. Pat. application Publications

| Publication Number | Publication Date | Applicant |
|---|---|---|
| 2011/0005441 A1 | Jan. 13, 2011 | Roche |

As an exemplary sewing product, quilts are a finished fabric product typically consisting of three layers: the top fabric or quilt top, backing material and batting (filler, sandwiched between the top and backing materials to give the quilt loft). The quilt tops are generally formed by piecing together multiple quilt blocks. The quilt blocks typically are assembled from multiple pieces of fabrics with contrasting colors and/or textures which are arranged in a geometric pattern which is pleasing to the eye.

Traditional means to fabricate the quilt blocks are a three-step process: (1) selecting one or more quilt block patterns and fabrics; (2) measuring and cutting fabrics into pieces which will form the quilt block patterns; (3) assembling the pieces by seaming to form the quilt block. Seaming is a sewing method used to join two pieces of fabric together in which the fabrics are overlapped slightly (requiring seam allowance) and stitched together with a needle and thread either by hand or with a sewing machine. The most desirable seam is "hidden" in the sense that it is hidden when viewed from the preferred presentation side of the finished quilt. A hidden seam is produced by inverting one of the pieces of fabric to be joined before the seam is sewn. After the seam is sewn the fabric is folded back, reversing the inversion and leaving the cut edges of both pieces of fabric which have been joined entirely on one side of the finished piece.

In preparing quilt blocks, for example, it has traditionally been difficult to assemble pattern units having curved or other free-form geometric shapes for the following reasons: (1) curved lines traced onto fabric and then cut by hand are frequently imprecise and variable which degrades the esthetic quality of each quilt block and leads to cumulative errors which degrade the geometric precision of assembly of the overall quilt; (2) the necessity of having a seam allowance means that the two pieces of fabric to be joined cannot be cut along a common cutting line, but must instead be cut separately to different shapes; (3) seaming curved pieces of fabrics creates tensions along the seam which cause the joined pieces fabric to bunch and fold in an unseemly fashion; and (4) when seaming along a curved path it is challenging to keep the excess fabric out of the way of the way when stitching along the seam.

Additionally, many quilt blocks possess geometric symmetry. It is desirable to take advantage of this symmetry by joining two pieces of fabric and then cutting them along one or more lines of symmetry to produce several pattern units simultaneously. Traditionally, quilt blocks which are fabricated by hand do not take advantage of this symmetry, resulting in the need to mark and cut all pieces individually.

There have been many prior art attempts to overcome these limitations, some of which have been patented as below.

U.S. Pat. No. 5,791,062 (Walker), U.S. Pat. No. 6,944,963 (Amaru), U.S. Pat. No. 7,281,337 (Oehlke and Moen), U.S. Pat. No. 7,383,640 (Barry) and U.S. Pat. No. 7,946,042 (Williams) attempt to overcome these limitations by using rigid templates which indicate the locations for sewing and cutting. These approaches suffer because the types and sizes of curved elements are restricted to those inherent in the template, which do not afford the quilter free choice to select a curved path which is desirable to them based on esthetics or to conform to a pre-existing quilting pattern. U.S. Pat. No. 5,791,062 (Walker) is limited to providing a template which guides the cutting of fabric using a hand cutting device such as a rotary cutter along a pre-determined number of curves which consist of portions of circles with a limited number of pre-determined radii. U.S. Pat. No. 6,944,963 (Amaru) and U.S. Pat. No. 7,383,640 (Barry) are similar except that in each case the template described provides a limited number of repeating undulating contours. U.S. Pat. No. 7,946,042 (Williams) is a template that is a variation of a drafter's compass, and is limited to facilitating the construction of a specific quilting pattern known as the Mariner's Compass star which is constructed in part out of curves which consist of portions of circles. U.S. Pat. No. 7,281,337 (Oehlke and Moen) describe a template which assists in the joining of fabric; however the template is limited to joining fabrics along straight lines.

Other art is known in commercial product offerings. For example, the Curve Master Presser Foot™ is a commercial product that facilitates the joining of fabric along curved seams, but is difficult to use in practice as evidenced by the number of hints included in the directions and the need to use a special set of bent tip tweezers. Furthermore the Curve Master Presser Foot™ offers no assistance in the cutting of fabric or in producing many pattern units simultaneously.

The Accuquilt Go! Fabric Cutter™ cuts fabric using a press and die. Available dies include curved shapes suitable for sewing curved seams. The Accuquilt Go! Fabric Cutter™ suffers because a unique die must be used for each desired shape. The quilter must choose a curved path from among a limited number of choices defined by the dies which are available, and is unable to modify the curve based on esthetic desire or the need to conform to a pre-existing pattern.

Many guides and instructions available to quilters attempt to overcome the difficulty of producing curved seams by using 'workarounds'. These workarounds compromise the perceived artistry of the finished quilt. One common workaround is to simplify the task of joining the pieces by using a simple top or more decorative applique stitch. Layers of fabric are laid on top of each other and sewn together without inverting one of the pieces of fabric being joined. Since the fabric is not inverted the thread of the seam and an edge of one of the pieces of joined fabric are visible on each side of the finished piece.

Additional related art is described in U.S. Patent Application 2011/0005441 (Roche). Fabrication of quilt blocks is facilitated by use of an embroidery machine. A quilter retrieves a digitized embroidery file that is fed into an embroidery machine. The file instructs the embroidery machine to stitch quilt layers together according to a pre-determined pattern. The art teaches that the layers shall be in the form of one or more applique layers applied to a base layer with a tack down stitch. No provision is provided for generating curved seams by using the embroidery machine in combination with appropriate instructions in the digitized embroidery file.

BRIEF SUMMARY OF EXEMPLARY ASPECTS OF THE INVENTION

In accordance with one exemplary embodiment, a stabilizer substrate is secured in an embroidery hoop where the stabilizer is of a body and weight that can be easily penetrated by a sewing needle. A user retrieves a digitized file that is downloaded to an embroidery machine. The digitized file initially instructs the embroidery machine to: 1) stitch cutting and placement guidelines; and 2) stitch a closed line having the desired arbitrary shape so as to create a perforated guide for an opening in the stabilizer. The user then separates the stabilizer along the perforated guide line and removes the center piece to create an opening. A piece of fabric is then temporarily attached to one side of the stabilizer held in the embroidery hoop. The user then cuts the fabric inside the opening, generally following the opening edge but leaving a seam allowance margin. The user then makes a series of cuts in the seam allowance margin to provide relief from tension when the fabric is subsequently folded. The margin is then folded through the opening onto the opposing side of the stabilizer so that the opening returns to its original dimension and the margin now surrounds the opening. The folded over margin is then temporarily attached to the reverse side of the stabilizer. An adhesive is then applied to the exposed face of the folded-over seam allowance margin. The user then aligns and, with the aid of the adhesive, bonds a second piece of fabric to the seam margin on the back side of the fabric and stabilizer assembly relative to the location of the first piece of fabric. The embroidery hoop is then returned to the embroidery machine and the digitized file continues by now instructing the embroidery machine to again stitch along the closed line which incorporates the desired arbitrary shape and which now follows the edge of the opening. Whereas initially the stitch created a perforated guide for the opening, the second stitch is the seaming stitch which joins the two pieces of fabric. While the embroidery machine is stitching the seam the user lifts the first fabric and keeps it clear of the needle. The fabric is then removed from the hoop and the perimeter edges are cut to form a quilt pattern unit, which may be a completed quilt block. The quilt pattern unit may also be cut into smaller units following the cutting guides created in the first step. The remaining stabilizer is then separated and removed from the fabric assembly by loosening the temporary adhesive. The second fabric is then trimmed along the edge of the first fabric seam allowance to yield the finished quilt block pattern units.

According to particular exemplary aspects, the disclosed methods enable: two pieces of fabric to be joined precisely along a pre-determined curved line; performing such actions reproducibly so that quilt block pattern units formed from the joined pieces of fabric are uniform and can be assembled into a quilt without variation or cumulative geometric errors that degrade the esthetic appeal of the quilt; joining the fabric using a hidden seam that remains hidden when viewed from one side so as to enhance the esthetic appeal of quilt block pattern units formed from the joined pieces of fabric; reducing the number of sewing and cutting operations required to produce the quilt block pattern units compared to alternative methods; use of geometric symmetry to provide additional reductions in the operational steps by producing two or more desired quilt block pattern units simultaneously.

Particular aspects provide a method for joining fabric pieces to provide a fabric pattern piece with a hidden seam, comprising: securing a stabilizing material in a holding member (e.g., an embroidery hoop) and mounting said holding member with said stabilizing material to a stitching machine (e.g. sewing or embroidery machine); stitching, with or without thread and using the machine, a perforated guide-line in the stabilizing material outlining a shape to be opened therein; detaching the stabilizing material within the perforated guide-line to form an opening in the stabilizing material having the shape; adhering, using a temporary adhesive, a first piece of fabric to the stabilizer material, wherein the first piece of fabric covers the opening in the stabilizing material; cutting the adhered first piece of fabric inside the stabilizing material opening and following the edge thereof while maintaining a suitable joining seam margin to provide an adhered first material comprising an opening defined by a non-adhered joining seam margin substantially conforming in shape to that of the opening in the stabilizing material; cutting, generally orthogonally from the edge of the non-adhered joining seam margin, a plurality of cuts or slits therein to provide a foldable joining seam margin; folding the foldable joining seam margin through the opening in the stabilizing material and adhering, using a temporary adhesive, the folded joining seam margin onto the reverse side of the stabilizing material to provide a folded adhered joining seam margin; adhering, using a temporary adhesive, a second piece of fabric to the stabilizing material on the side opposite that of the adhered first piece of fabric, wherein the second piece of fabric covers the folded adhered joining seam margin of the first piece of fabric; and separating, at least partially, the adhered first fabric from the stabilizing material to expose the perforated edge of the opening in the stabilizing material and stitching, with thread and using the machine, a seam adjacent to but not including the edge of the stabilizer material defining the opening therein, the seam joining the folded adhered joining seam margin of the first piece of fabric to the second piece of fabric to produce a fabric pattern piece having a front and a back side, wherein the stitching of the seam is not visible on the front side thereof.

Particular aspects comprise, after stitching the seam joining the folded adhered joining seam margin of the first piece of fabric to the second piece of fabric, removing, at least in part, the stabilizing material from between the first and second pieces of fabric.

Particular aspects comprise, after stitching the seam joining the folded adhered joining seam margin of the first piece of fabric to the second piece of fabric, cutting away at least a portion of the second piece of fabric that extends beyond the outside edge of the folded adhered joining seam margin of the first piece of fabric.

In certain embodiments, the shape comprises a curve.

Certain embodiments comprise stitching, with or without thread and using the machine, at least one of guidelines defining outer edges of the fabric pattern piece, fabric cutting guidelines and fabric placement guidelines. In particular aspects, the first piece of fabric is larger than the outer edges of the fabric pattern piece.

In particular implementations adhering, using the temporary adhesive, the second piece of fabric to the stabilizing material on the side opposite that of the adhered first piece of fabric additionally comprises adhering the second piece of fabric to the exposed non-adhered surface of the folded adhered joining seam margin by means of a temporary or permanent adhesive.

In certain aspects, the second piece of fabric covers the opening in the stabilizing material and the folded adhered joining seam margin of the first material.

In particular embodiments separating, at least partially, the adhered first fabric from the stabilizing material to expose the perforated edge of the opening in the stabilizing material is progressive or incremental as the stitching proceeds.

In particular embodiments, the fabric pattern piece comprises a quilt block unit.

In certain computer implemented aspects, the stitching in the method is computer implemented, and wherein stitching, with or without thread and using the machine, a perforated guide-line in the stabilizing material outlining a shape to be opened therein, comprises transmitting a digitized software program or file that provides sewing pattern instructions to said stitching machine, and activating the digitized file to perform said stitching. In particular embodiments, stitching, with thread and using the machine, a seam adjacent to but not including the edge of the stabilizer material defining the opening therein, the seam joining the folded adhered joining seam margin of the first piece of fabric to the second piece of fabric to produce a fabric pattern piece having a front and a back side, comprises activating the digitized file to perform said stitching.

Additional aspects provide a method of assembling a quilt block pattern unit comprising: securing a stabilizing material in an embroidery hoop and attaching said embroidery hoop to an embroidery machine; transmitting a digitized embroidery file that provides sewing pattern instructions to said embroidery machine; activating the digitized embroidery file so that the embroidery machine stitches a cutting guide into the stabilizing material defining the outside edges of a quilt pattern piece and a perforated guide-line in the stabilizing material outlining a shape to be opened therein, wherein the shape comprises a curve; detaching the stabilizing material from the opening along the perforated guide-line; adhering a first piece of fabric which is larger than the outside edges of the quilt pattern piece to the stabilizing material using a temporary adhesive; cutting the adhered first fabric piece inside the opening following the edge but maintaining a margin suitable for formation of a joining seam; further cutting the adhered fabric orthogonally to the opening edge at short intervals (e.g., between about 1/16" and about 1"), to provide for tension relief when the fabric is later folded; folding the margin down through the opening and back onto the reverse side of the stabilizer material; adhering the fabric to the reverse side of the stabilizer using a temporary adhesive; further applying an external adhesive to the margin which has been folded back (e.g., wherein the adhesive is applied by spraying, brushing or wiping on the fabric margin, and wherein the adhesive comprises a permanent or temporary adhesive); laying a second piece of fabric on top of the first fabric margin and securing the second piece of fabric by means of the applied adhesive; and activating the digitized embroidery file so that the embroidery machine stitches a seam which joins the two pieces of fabric around the edge of the opening in the stabilizer material to produce a quilt block pattern having a front and a back side, wherein the stitching of the seam is not visible on the front side thereof.

Particular aspects comprise, after stitching the seam joining the two pieces of fabric, at least one of: removing, at least in part, the stabilizing material from between the first and second pieces of fabric; and cutting away at least a portion of the second piece of fabric that extends beyond the outside edge of the folded seam margin of the first piece of fabric.

In certain embodiments, the temporary adhesive comprises at least one of a heat fusible coating on the stabilizing material, heat fusible wax, and an artificial coating.

In particular aspects, at least one temporary adhesive may be applied externally by spraying, brushing or wiping on the stabilizer surface, or by any other suitable method of application.

In certain aspects, the stabilizer is termed, or comprises waxed paper or freezer paper, and is coated on at least one side with heat fusible wax or an artificial coating.

In particular embodiments, the external adhesive applied to the seam margin comprises a water soluble adhesive.

Yet additional aspects, provide a computer sewing or embroidery system, comprising: a computer sewing or embroidery machine; and software operative with the computer sewing or embroidery machine to practice the methods disclosed and/or claimed herein:

Yet further aspects, provide a computerized sewing or embroidery machine sewing instruction file product in a computer readable medium for use with a computerized sewing or embroidery machine, the computer embroidery machine sewing instruction file comprising: instructions for sewing stitches to place stitching, placement and cutting guides for a quilt pattern piece in a substrate held in an embroidery hoop; instructions to sew stitches which form at least one guide which demarcates the edge an opening which contains at least one line element having an arbitrary shape which may be curved; and instructions for sewing a joining seam between two pieces of fabric such that the seam is only visible from one side.

In particular embodiments, the instruction file product comprises instructions for at least one of: forming stitched cutting guides which facilitate separation of final fabric assemblies into one or more quilt pattern units; forming stitched cutting guides which incorporate two, three, four or higher lines of symmetry to facilitate separation of final quilt blocks into two or more quilt pattern units which are geometrically related by the previously identified lines of symmetry; forming stitched cutting guides which incorporate two, three, four or higher lines of symmetry to facilitate separation of final quilt blocks into two or more quilt pattern units which are identical; and forming stitched cutting guides which incorporate two, three, four or higher lines of symmetry to facilitate separation of final quilt blocks into two or more quilt pattern units which are mirror images of each other.

Other advantages of one or more aspects will be apparent from a consideration of the drawing and ensuing description.

BRIEF DESCRIPTION OF THE DRAWINGS

Aspects of the invention will best be understood by reference to the following detailed description, as well as illustrative embodiments when the description is read in conjunction with the accompanying drawings.

DETAILED DESCRIPTION

Figure 1:
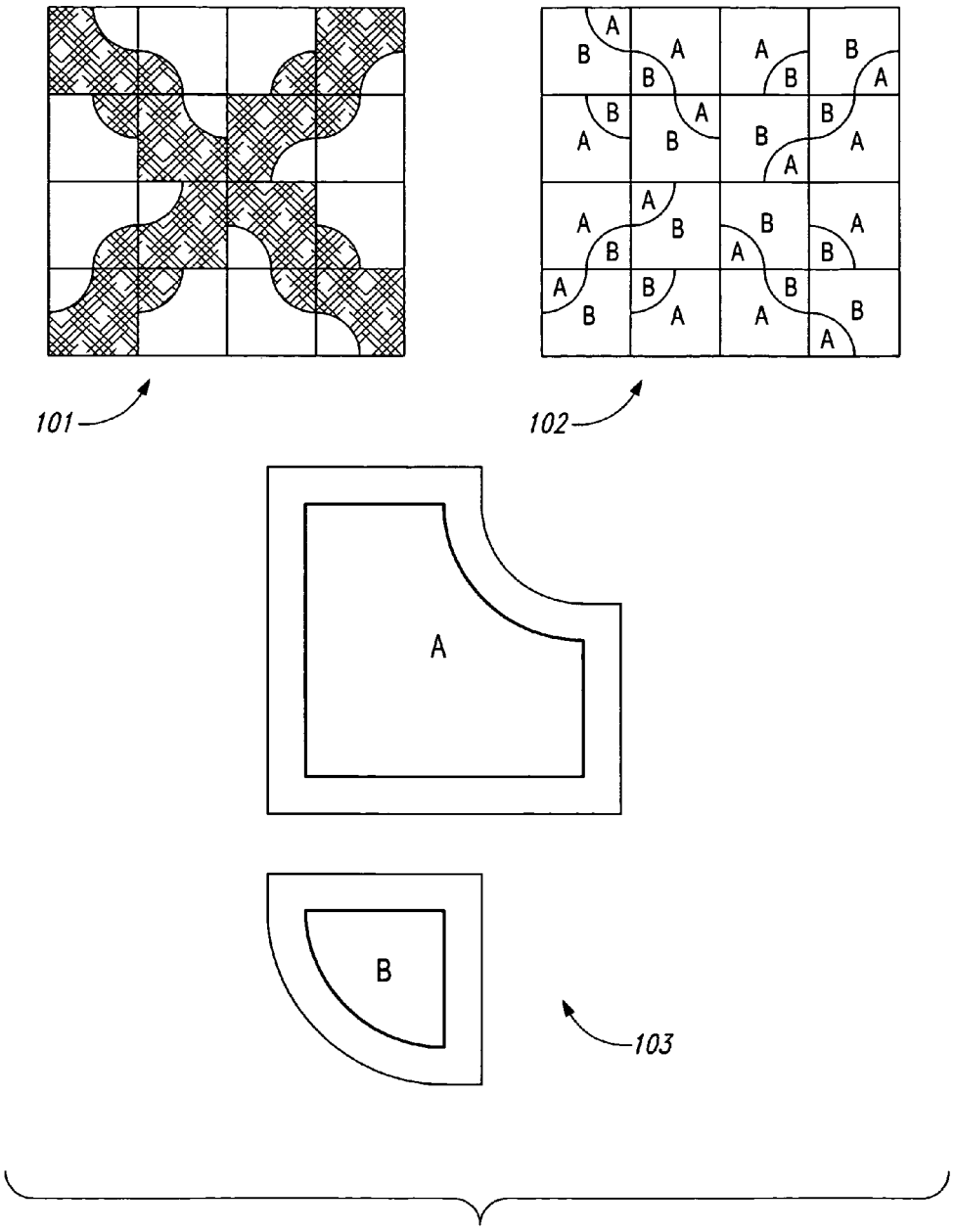
FIG. 1 show an exemplary quilt block pattern referred to as a Drunkard's Path.

An example of the prior art is shown in FIG. 1, which shows the pattern units required to create quilt blocks for a design which requires curved seams known as a "Drunkard's Path" quilt. Referring to FIG. 1, there is shown a finished traditional Drunkard's Path quilt block 101. Construction of a single block requires thirty-two curved pieces of fabric, sixteen each of two different colors and shapes as shown in 102. Four steps are required to fabricate these curved pieces of fabric: (1) tracing of two templates for each curved segment required as shown in FIG. 103; (2) cutting two pieces of fabric for each curved segment required; (3) physically easing the two pieces of fabric to enable a fit; and (4) stitching the curved seam. This four-step process is repeated for every curved pattern unit required for every quilt block used to compose the final quilt.

A typical small quilt would be constructed of 30 quilt blocks (an array of 5×6). To construct this quilt entirely of Drunkard's Path quilt blocks would require repeating these steps 480 times. Since steps (1), (2) and (3) are each applied to two pieces of fabric these actions would have to be repeated 960 times in order to create enough curved pieces of fabric. Step (4) alone would be repeated 480 times in order to joined the pieces together by stitching curved seams.

It is extremely difficult to repeat these many steps by hand exactly and without variation to produce a quilt which is geometrically precise in having symmetrical sides and square corners, which is a highly valued esthetic objective. Furthermore, the number of steps and their complexity means that the time required to complete a Drunkard's Path quilt is much longer than many alternate simpler quilt patterns. Therefore the Drunkard's Path, and other quilting patterns incorporating curved lines, has been regarded as extremely challenging which discourages many quilters.

Figure 2:
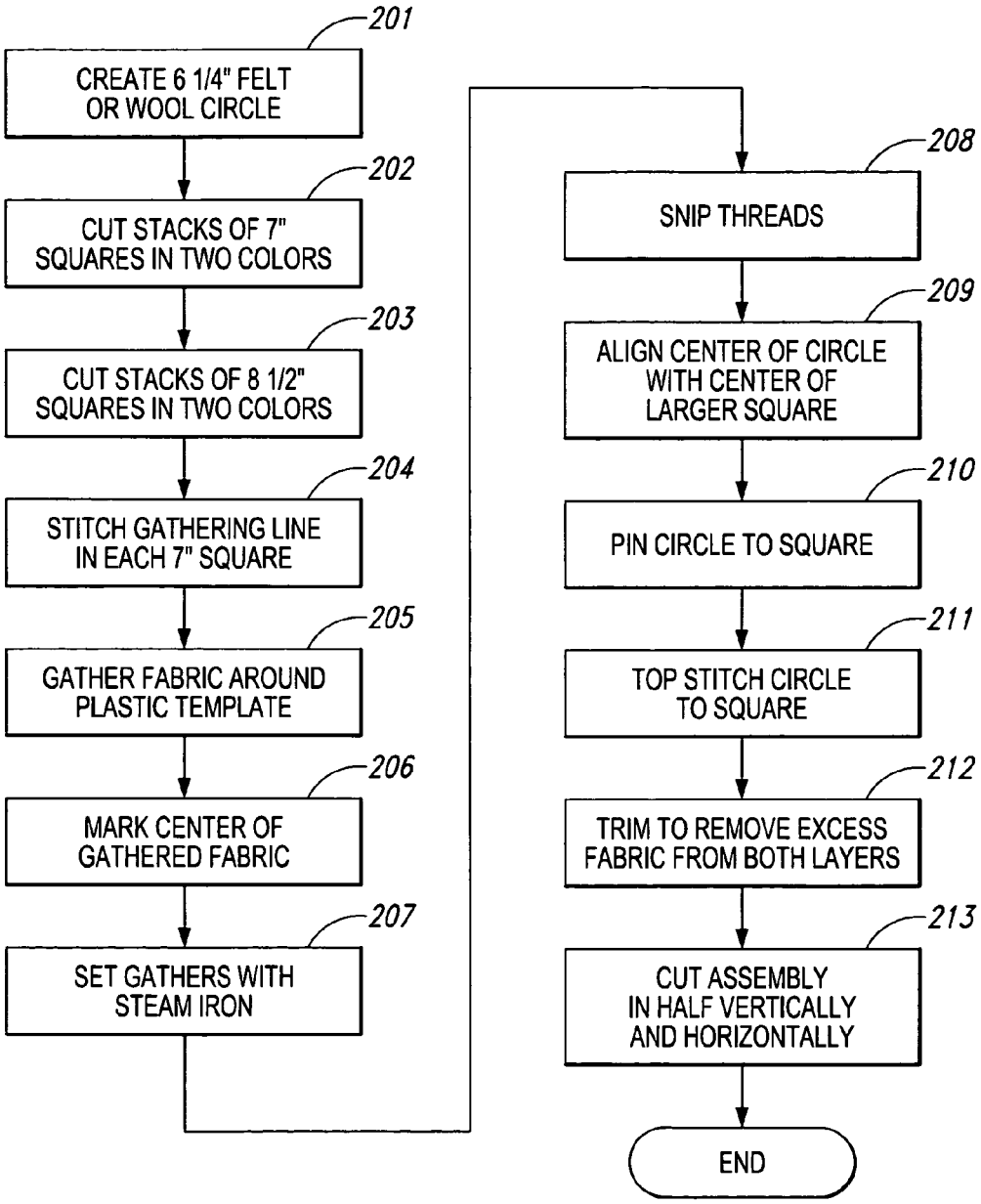
FIG. 2 shows a flowchart illustrating a prior art method which uses a fixed size template.

A second example of prior art, flowchart shown in FIG. 2, utilizes a fixed size and shaped template. The process includes: (1) creating a secondary template from felt or wool (step 201); (2) cutting stacks of fabric in 7" and 8½" squares (steps 202-203); (3) stitching a circle on each 7" fabric square, using the felt circle as a guide (step 204); (4) inserting the fixed plastic circle in the center of the stitched circle and pulling on the stitched threads to gather the excess fabric into the center of the square as the 7" fabric square is pulled into shape around the plastic template (steps 205-206); (5) setting the gathers by pressing the circle and applying steam (step 207); (6) securing and clipping the extra thread (step 208); (7) aligning the center/of the circle with the center of larger fabric square (step 209); (8) securing the circle to the fabric square with pins (step 210); (9) stitching a visible seam (top stitching) that joins the fabric circle to the larger square (step 211); (10) trimming out the center of the larger square which is internal to the top stitched circle (step 212); (11) trimming the excess fabric that is a result of gathering the 7" square into a circle (step 213); and (12) cutting the assembly in half vertically and again horizontally to into 4 segments that are ready to combine into quilt blocks.

There are several drawbacks to this second example of prior art. One is that the use of a fixed size and shaped template severely limits the application of this method because a separate template is needed for each type and size of curved element, severely restricting the versatility and applicability of this method. In addition, when a cutting template is used the most convenient seaming stitch used to assemble the fabric pieces is a top stitch, a stitch which is visible on both sides of the fabric and which is regarded as aesthetically inferior to a true hidden seam.

Figure 3:
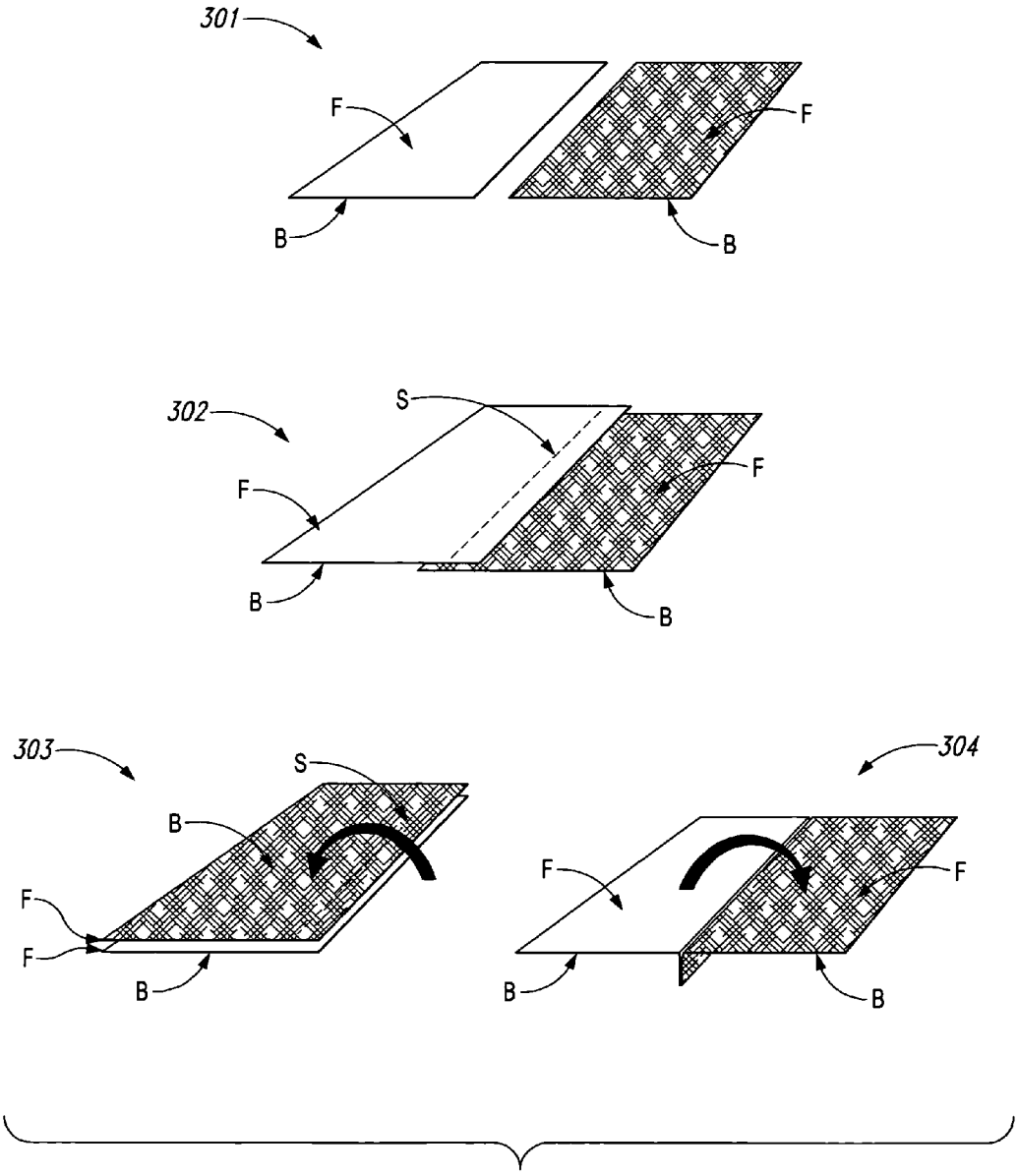
FIG. 3 show the difference between a top stitch seam and a hidden stitch seam.

The difference between a top stitch seam and a hidden seam can be appreciated by referring to FIG. 3. Two pieces of fabric are to be joined as shown in 301. To form a top stitch seam they are partially overlapped, and stitched along the overlap as shown in 302. The stitches (S) are visible from the front side (F) of the joined pieces. In contrast, to form a hidden seam, one piece of fabric is turned over and laid against the second piece so that the fronts (F) face each other as shown in 303. The fabric pieces are stitched together parallel to the edge (303). When the piece of fabric is returned to its original orientation the stitch (S) is on the backside (B) as are the unfinished edges of the two pieces of fabric as shown in 304. When viewed from the front side the joining seam is hidden.

Figure 4:
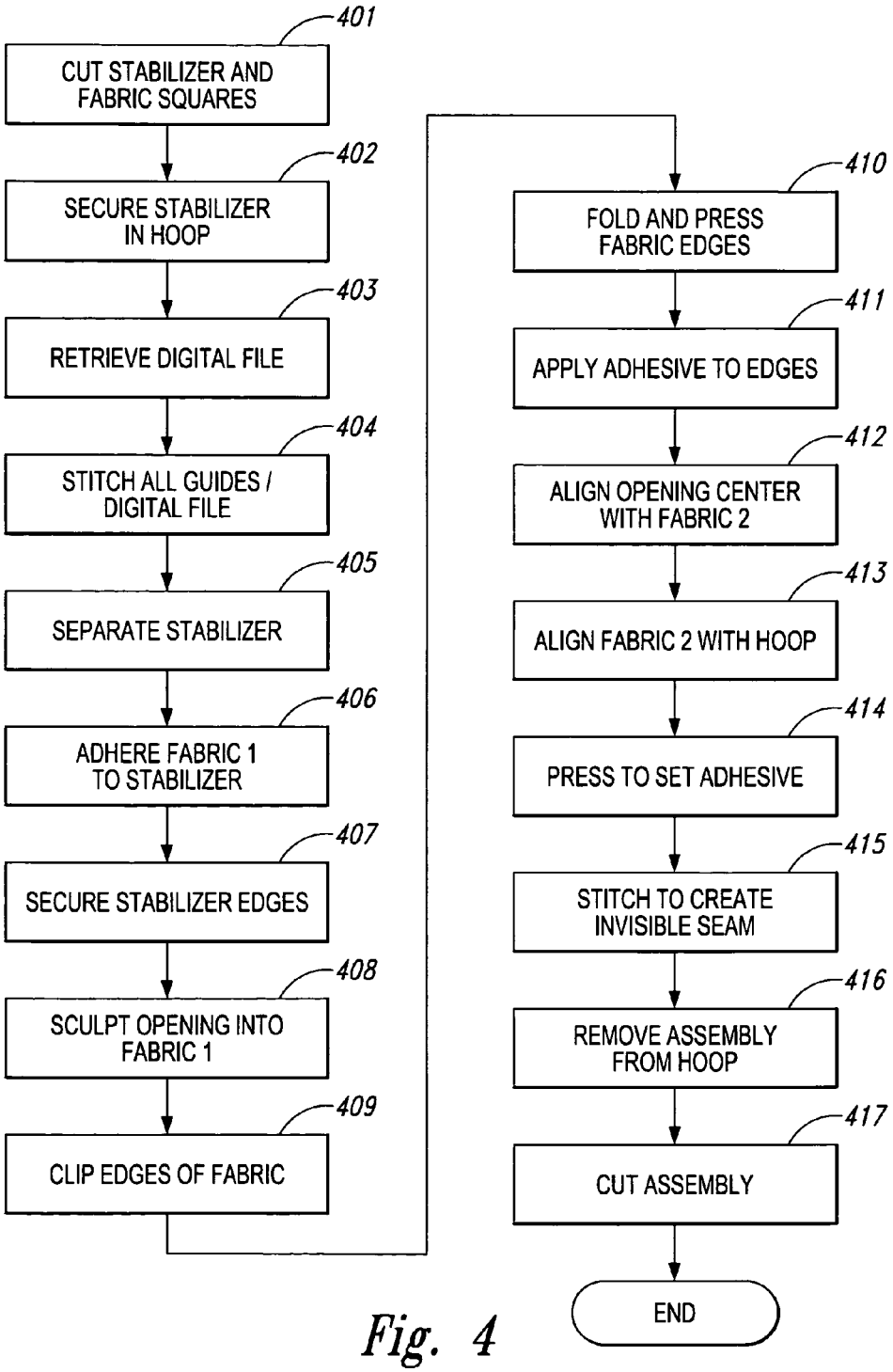
FIG. 4 shows a flowchart illustrating the steps of an exemplary embodiment of the present invention.

Referring now to FIG. 4, a flowchart illustrates aspects of the present invention in describing a method for joining two pieces of fabric along a line having an arbitrary shape which may be curved so that the seam remains hidden from one side. The process begins by cutting two pieces of a stabilizer substrate. It is most convenient when the stabilizer has a coating which allows the fabric to be temporarily attached. It is most convenient when the method of adhesion is by application of heat, as with an iron. However, any surface to which a temporary adhesive may be applied by spray, brush, wipe or other appropriate application method would be suitable. The stabilizer may be coated on one or both sides. If only one side is coated two sheets of stabilizer may be secured in the hoop with the coated sides facing out. If both sides are coated only one sheet of stabilizer may be used. When an external temporary adhesive is being used one or two sheets of stabilizer may be used as is convenient for the user. The stabilizer is also selected with a body and weight that can be easily penetrated by a sewing needle. In an exemplary embodiment the stabilizer substrate is freezer paper coated on one side with a heat fusible coating.

The stabilizer is cut to fit an embroidery hoop (step 401). Next, single (coated both sides) or dual (coated one side, adhering sides facing out) sheets are secured inside the embroidery hoop (step 402). The user then downloads a computerized embroidery file to their embroidery machine (step 403). The file is created using a category of computer programs known as embroidery digitizing software. The user of these programs enters sewing instructions which consider the location of start and end points for stitched lines, the shape of the stitched line between the start and end points, the sequence if multiple lines are stitched, the need to change threads if multiple colors and/or weights of thread are used, and the stitch density (distance between two stitches). The user considers how to separate out the desired end pattern into sections and layers, and how each section relates to the others during the process of producing the desired end pattern. Once the embroidery machine sewing instructions are completed, the user saves the file in one or more formats which are compatible with the embroidery machine(s) which will be used to execute the digitized file. Commonly used file formats include, but are not limited to, PES, VIP, VP3, HUS, JEF, EXP, SHV, DST, and Singer Triple X. In accordance with this use of embroidery digitizing software in this embodiment of the present invention the digitized file instructs the embroidery machine to stitch all cutting and placement guidelines, and to create a perforated guide line outlining an opening according to a predetermined algorithm (step 404).

After the guides are stitched, the hoop is removed from the embroidery machine and the perforated center is removed from the stabilizer to form an opening (step 405). A fabric square which will become the outer section of the assembly is then bonded to the stabilizer (step 406). In an exemplary embodiment, the method of bonding is by using an iron to apply heat and fuse a heat fusible coating on the stabilizer to the fabric. If using two pieces of stabilizer at this point the internal edges of the stabilizer may be glued together (step 407) to enhance stability, though this step may not be necessary if the stabilizer has sufficient inherent stability.

Working from the backside of the embroidery hoop and using the opening as a guide, the center of the fabric is sculpted, creating an opening that is approximately one half inch in diameter smaller than the original opening (step 408). The decreased size is due to creating a seam allowance. Practitioners in the art typically select ¼" (one quarter inch) as a seam allowance, but the method is not restricted to this value alone.

The user will use a scissors or other cutting implement to make cuts in the edges of the fabric opening, approximately orthogonal to the opening edge, at short intervals (typically in the rage of 1/16" to 1") to provide tension relief when the fabric is folded back (step 409). The clipped edges are then folded through the opening and against the back side of the stabilizer (step 410). The second fabric is then bonded to the assembly using an adhesive which may be sprayed on, brushed on, wiped on, dispensed from an applicator tip or otherwise applied to the clipped edges (step 411). In an exemplary embodiment a thin bead of washable glue is applied to the back side of the clipped edges using a dispensing tip and bottle of adhesive. The stabilizer that was previously removed to form the opening may then be aligned over the center of the fabric square that will become the inside of the assembly (step 412) where it can serve as a guide for the alignment and orientation of the second piece of fabric to be joined. The second piece of fabric is then aligned with the fabric and stabilizer that is in the embroidery hoop (step 413) and joined (step 414) by means of the adhesive that was previously applied (step 411). In an exemplary embodiment the fabrics are pressed together using an iron to set the adhesive and bond the two pieces of fabric, though this step may be omitted if the adhesive does not benefit from the application of heat. The embroidery hoop is reattached to the embroidery machine and in accordance with the use of embroidery digitizing software in this embodiment of the present invention the digitized file instructs the embroidery machine to stitch the final hidden seam (step 415). The embroidery hoop is removed from the sewing machine and the assembly is removed from the embroidery hoop (step 416).

The first piece of fabric is cut back to form the perimeter of the finished piece using the stitched guides, and excess material from the second piece of fabric is trimmed away from the joining seam (step 417). The finished assembly may be used whole or cut into segments using the stitched guidelines thereby rendering the assembly or segments ready to be joined together or combined with other elements in the construct of a quilt block.

Figure 5:
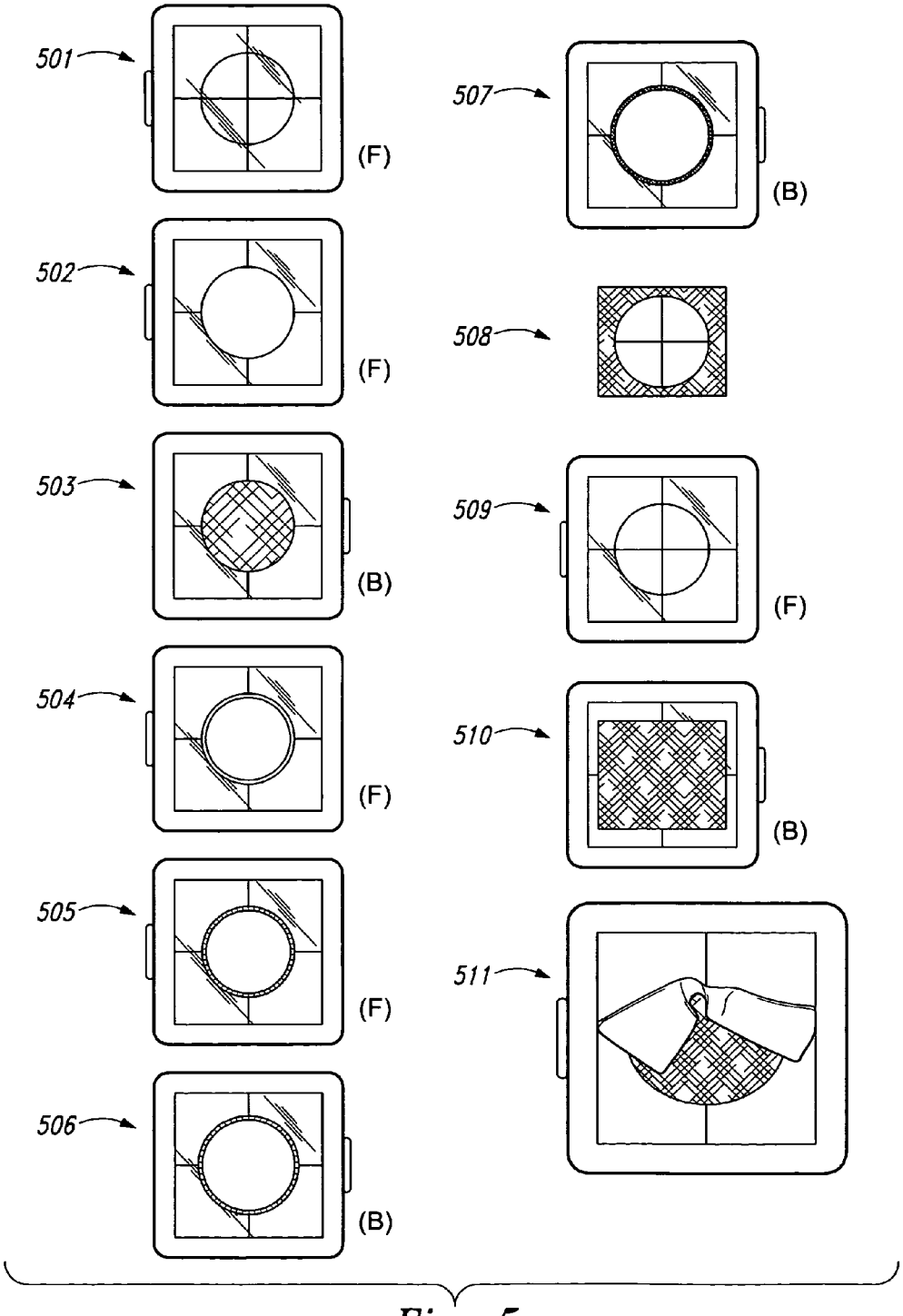
FIG. 5 show an exemplary implementation to create a fabric assembly.

This sequence of steps is illustrated in FIG. 5. The initial stitching of the guides and creation of a stitched perforated guide line around the edge of an opening are shown as 501 in FIG. 5. The opening is then removed as shown in 502. The first piece of fabric is then attached to the assembly, viewed from the backside (B) as 503. The opening is then used to sculpt the attached first piece of fabric as shown in 504. The fabric is then cut at short intervals generally orthogonal to the stabilizer as shown in 505. The cut fabric is then pushed through the opening and bonded to the back side of the stabilizer, forming a finished edge on the front side (F) of the first fabric as shown in 506 and providing a seam allowance on the backside. Adhesive is then applied to the folded back seam allowance on the backside of the embroidery hoop as shown in 507. The removed stabilizer center is then centered over the second piece of fabric as shown in 508. Optionally, the center and second piece of fabric are then aligned with the first piece of fabric in the opening in the embroidery hoop as shown in 509. The second piece of fabric is then bonded to the first piece of fabric from the back side of the embroidery hoop as shown in 510, using the adhesive previously applied 507. The embroidery hoop is then turned over and reattached to the embroidery machine. The embroidery machine is used to stitch out the seam line, keeping the first fabric clear of the needle by flipping down the first piece of fabric to expose the perforated edge as shown in 511.

Figure 6:
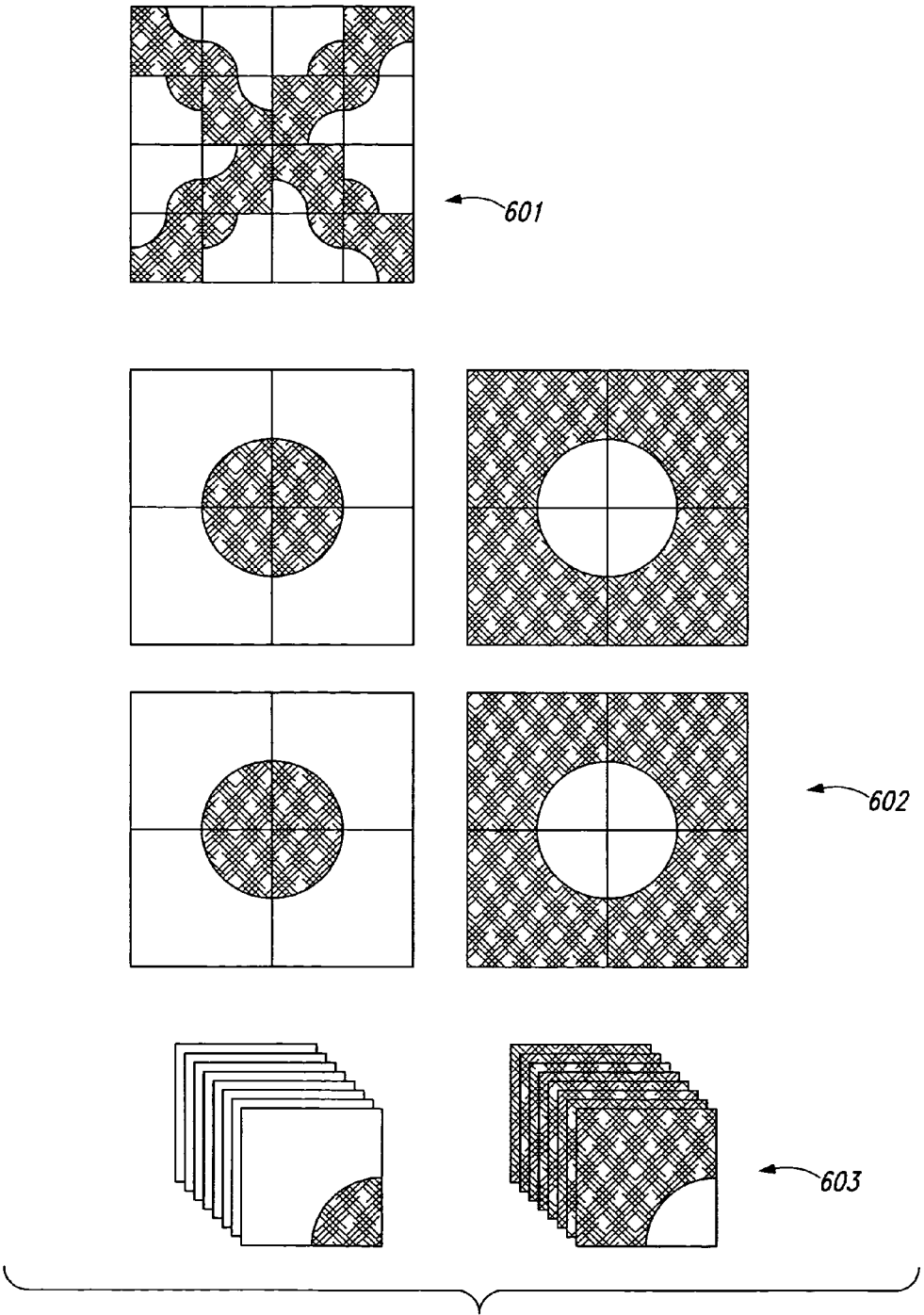
FIG. 6 show how the fabric assembly of FIG. 5 is used to create the quilt pattern units used for the Drunkard's Path quilt block pattern.

Particular advantages of the present invention, without limitation, are illustrated by applying the method to the previous example of the Drunkard's Path, as shown in FIG. 6. A single block of this quilt is shown as 601. According to the prior art of hand assembly, a small quilt consisting of 30 quilt blocks would require 960 instances of tracing, cutting and physically easing pieces of fabric, followed by 480 instances of stitching the curved seam. In order to construct a single block the present invention would use stitching guides in which the desired curved line would consist of a circle centered in a square 602. In this case the present invention takes advantage of vertical and horizontal mirror image symmetry, and marks vertical and horizontal cutting guides through the center of the fabric assembly. Cutting each finished two fabric assembly along the horizontal and vertical center lines, 602, would create four of the desired curved pattern units, 603. Assembling and cutting four assemblies would create sixteen desired pattern units, 603, sufficient to produce one quilt block. The actions for one quilt block would be: (1) stitching guides in the hoop 4 times; (2) removing the perforated center of the stabilizer 4 times; (3) easing the first fabric 4 times; (4) seaming a second fabric to the first fabric 4 times; (5) cutting away the excess second fabric 4 times; and (6) cutting each template into quarters, requiring 8 cuts total. Thus, a small quilt of 30 quilt blocks would require 120 instances of guide stitching and 480 cutting, 120 easing and 120 seaming actions. This is a dramatic reduction in the number of operations required relative to hand assembly. Furthermore, the cutting away of the excess second fabric and the straight line cuts dividing the assembled templates are simpler actions to perform than making a curved cut, and the difficult seaming action is carried out more easily and with greater precision by giving the embroidery machine instructions and letting the machine carry out this task.

Particular exemplary advantages of the present invention may also be contrasted with the prior art of using a fixed size and shaped template. In contrast to the prior art, the present invention may be adapted to produce any desired line having an arbitrary shape which may be curved. The prior art is severely restricted in that each desired line requires a specific template of a fixed size and shape which cannot be changed. In terms of the number of operations that must be carried out to create the example Drunkard's Path quilt, this prior art is similar to the present invention in using a template consisting of a circle on a square and the number of cutting, easing and seaming operations. However, additional steps are required including tightly gathering the fabric to create a smooth bump free edge which must be set with ironing to create a very sharp hard crease, and then removing the template one piece at a time without disturbing the assembly. There is no provision in this prior art for facilitating the assembly of fabric pieces using a seaming stitch which is hidden on one side of the fabric. Instead, the most commonly used seaming stitch is a top stitch, in which the pieces of fabric are overlapped and sewed together, so that the cut edge of at least one piece of fabric is visible on both sides of the fabric assembly. Typically, in the quilting arts, a top stitch is regarded as aesthetically inferior to a true hidden seam.

Additional exemplary advantages of the present invention over prior art is that quilt block pattern units containing lines having an arbitrary shape which may be curved can be created faster and more precisely in a manner that allows the joining seam to remain hidden from one side. The prior art presents two options. In the first option, one is required to: 1) trace two templates; 2) cut two pieces of fabric; 3) ease fabric pieces to fit; and 4) stitch a complex curved seam for every curved segment required. In the second option, one is required to: 1) create a secondary template from felt or wool; 2) cut stacks of fabric in 7" and 8½" squares; 3) stitch a circle on each 7" fabric square, using the felt circle as a guide; 4) insert the fixed plastic circle in the center of the stitched circle then pull on the stitched threads to gather the excess fabric into the center of the square as the 7" fabric square is pulled into shape around the plastic template; 5) set the gathers by pressing the circle and applying steam; 6) secure and clip the extra thread; 7) align the center of the circle with the center of larger fabric square; 8) secure the circle to the fabric square with pins;) stitch a visible seam (top stitch) that joins the fabric circle to the larger square; 9) trim out the center of the larger square which is internal to the top stitched circle; 10) trim the excess fabric that is a result of gathering the 7" square into a circle; 11) cutting the assembly in half vertically and again horizontally to into 4 segments that are ready to combine into quilt blocks.

In embodiments of the present invention, a set of digital instructions sent to an embroidery machine creates a geometrically precise composite shape which may include curved segments and which may be used in its entirety or cut to provide smaller quilt block pattern units and joined with seams which are hidden from one side. Where advantageous, the instructions conveyed by the computer program product to the embroidery machine may specify that the cutting guides facilitate separation of the final quilt fabric assembly into two or more quilt pattern units, and further that advantage might be taken of lines of symmetry to facilitate separation of final quilt blocks into two or more quilt pattern units which are geometrically related by the selected line(s) of symmetry. The invention avoids the problem of misaligning two fabrics that must be eased together while manually stitching complex curved seams. The composite shape is ready to use after trimming or may be cut to provide curved segments are ready to be combined or joined with other fabric elements to create quilt blocks.

Although not required, implementations are described in the general context of computer-executable instructions, such as program modules, being executed by a computer or a dedicated applied smart device (e.g., an embroidery machine, or the like). Generally, program modules include routines, programs, objects, components, data structures, etc., that perform particular tasks or implement particular abstract data types.

Moreover, those skilled in the art will appreciate that implementations may be practiced with other computer system configurations, including other devices, multiprocessor systems, microprocessor-based or programmable consumer electronics, network PCs, minicomputers, mainframe computers, cloud computing architectures, and the like. Implementations may also be practiced in distributed computing environments where tasks are performed by remote processing devices that are linked through one or more communications networks. In a distributed computing environment, program modules may be located in both local and remote memory storage devices.

Exemplary hardware and operating environments may include a general-purpose computing device in the form of a computing device. The computing device includes the system memory, a processing unit, and a system bus that operatively couples various system components, including the system memory, to the processing unit. There may be only one or there may be more than one processing unit, such that the processor of computing device comprises a single central-processing unit (CPU), or a plurality of processing units, commonly referred to as a parallel processing environment. The computing device may be a computerized sewing or embroidering machine/device, or any other type of computing based device suitable to implement the methods disclosed herein.

The system bus may be any of several types of bus structures including a memory bus or memory controller, a peripheral bus, and a local bus using any of a variety of bus architectures. The system memory may also be referred to as simply the memory, and may include read only memory (ROM) and random access memory (RAM). A basic input/output system (BIOS), containing the basic routines that help to transfer information between elements within the computing device, such as during start-up, may be stored in ROM. The computing device may further include a hard disk drive for reading from and writing to a hard disk, a magnetic disk drive for reading from or writing to a removable magnetic disk, and an optical disk drive for reading from or writing to a removable optical disk such as a CD ROM, DVD, or other optical media. The computing device may also include one or more other types of memory devices (e.g., flash memory storage devices and the like).

The hard disk drive, magnetic disk drive, and optical disk drive are connected to the system bus by a hard disk drive interface, a magnetic disk drive interface, and an optical disk drive interface, respectively. The drives and their associated computer-readable media provide nonvolatile storage of computer-readable instructions, data structures, program modules, and other data for the computing device. It should be appreciated by those skilled in the art that any type of computer-readable media which can store data that is accessible by a computer, such as magnetic cassettes, flash memory cards, USB drives, digital video disks, Bernoulli cartridges, random access memories (RAMs), read only memories (ROMs), and the like, may be used in the exemplary operating environment to affect the methods disclosed herein. As is apparent to those of ordinary skill in the art, the hard disk drive and other forms of computer-readable media (e.g., the removable magnetic disk, the removable optical disk, flash memory cards, USB drives, and the like) accessible by the processing unit may be considered components of the system memory.

A number of program modules may be stored on the hard disk drive, magnetic disk, optical disk, ROM, or RAM, including an operating system, one or more application programs, other program modules (e.g., one or more of the modules and applications described above), and program data. A user may enter commands and information into the computing device through input devices such as a keyboard and pointing device. Other input devices may include a microphone, joystick, game pad, satellite dish, scanner, or the like. These and other input devices are often connected to the processing unit through a serial port interface that is coupled to the system bus, but may be connected by other interfaces, such as a parallel port, game port, a universal serial bus (USB), or the like. A monitor or other type of display device is also connected to the system bus via an interface, such as a video adapter. In addition to the monitor, computers typically include other peripheral output devices (not shown), such as speakers and printers.

The computing device may operate in a networked environment using logical connections to one or more remote computers or servers. These logical connections are achieved by a communication device coupled to or a part of the computing device (as the local computer). Implementations are not limited to a particular type of communications device. The remote computer may be another computer, a server, a router, a network PC, a client, a memory storage device, a peer device or other common network node, and typically includes many or all of the elements described above relative to the computing device. The remote computer may be connected to a memory storage device. The logical connections may include a local-area network (LAN) and a wide-area network (WAN). Such networking environments are commonplace in offices, enterprise-wide computer networks, intranets and the Internet.

When used in a LAN-networking environment, the computing device is connected to the local area network through a network interface or adapter, which is one type of communications device. When used in a WAN-networking environment, the computing device typically includes a modem, a type of communications device, or any other type of communications device for establishing communications over the wide area network, such as the Internet. The modem, which may be internal or external, is connected to the system bus via the serial port interface. In a networked environment, program modules depicted relative to the personal computing device, or portions thereof, may be stored in the remote computer and/or the remote memory storage device. It is appreciated that the network connections shown are exemplary and other means of and communications devices for establishing a communications link between the computers may be used.

The computing device and related components have been presented herein by way of particular example and also by abstraction in order to facilitate a high-level view of the concepts disclosed. The actual technical design and implementation may vary based on particular implementation while maintaining the overall nature of the concepts disclosed.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

The description of exemplary embodiments of the present invention has been presented for purposes of illustration and description, and is not intended to be exhaustive or limited to the invention in the form disclosed. Many modifications and variations will be apparent to those of ordinary skill in the art. The disclosed embodiments were chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the inventions as disclosed by the claims.

I claim:

1. A method for joining fabric pieces to provide a fabric pattern piece with a hidden seam, comprising:

securing a stabilizing material in a holding member with or without thread and mounting said holding member with said stabilizing material to a stitching machine;

using the stitching machine to create a perforated guide-line in the stabilizing material outlining a shape to be opened therein;

detaching the stabilizing material within the perforated guide-line to form a pre-determined opening in the stabilizing material having the shape;

adhering, using a temporary adhesive, a first piece of fabric to the stabilizer material, wherein the first piece of fabric covers the opening in the stabilizing material;

cutting the adhered first piece of fabric inside the stabilizing material opening and following the edge thereof while maintaining a suitable joining seam margin to provide an adhered first material comprising a pre-determined opening defined by a non-adhered joining seam margin substantially conforming in shape to that of the opening in the stabilizing material;

cutting, generally orthogonally from the edge of the non-adhered joining seam margin, a plurality of cuts or slits therein to provide a foldable joining seam margin;

folding the foldable joining seam margin through the opening in the stabilizing material and adhering, using a temporary adhesive, the folded joining seam margin onto the reverse side of the stabilizing material to provide a folded adhered joining seam margin;

adhering, using a temporary adhesive, a second piece of fabric to the stabilizing material on the side opposite that of the adhered first piece of fabric, wherein the second piece of fabric covers the folded adhered joining seam margin of the first piece of fabric; and separating, at least partially, the adhered first fabric from the stabilizing material to expose the perforated edge of the opening in the stabilizing material and stitching, with thread and using the stitching machine, a seam adjacent to but preferably not including the edge of the stabilizer material defining the opening therein, the seam joining the folded adhered joining seam margin of the first piece of fabric to the second piece of fabric to produce a fabric pattern piece having a front and a back side, wherein the stitching of the seam is not visible on the front side thereof.

2. The method of claim 1, comprising, after stitching the seam joining the folded adhered joining seam margin of the first piece of fabric to the second piece of fabric, removing, at least in part, the stabilizing material from between the first and second pieces of fabric.

3. The method of claim 1, comprising, after stitching the seam joining the folded adhered joining seam margin of the first piece of fabric to the second piece of fabric, cutting away at least a portion of the second piece of fabric that extends beyond the outside edge of the folded adhered joining seam margin of the first piece of fabric.

4. The method of claim 1, wherein the shape comprises a curve.

5. The method of claim 1, comprising stitching, with or without thread and using the machine, at least one of guidelines defining outer edges of the fabric pattern piece, fabric cutting guidelines and fabric placement guidelines, and wherein the first piece of fabric is larger than the outer edges of the fabric pattern piece.

6. The method of claim 1, wherein adhering, using the temporary adhesive, the second piece of fabric to the stabilizing material on the side opposite that of the adhered first piece of fabric additionally comprises adhering the second piece of fabric to the exposed non-adhered surface of the folded adhered joining seam margin by means of a temporary or permanent adhesive.

7. The method of claim 1, wherein the second piece of fabric covers the opening in the stabilizing material and the folded adhered joining seam margin of the first material.

8. The method of claim 1, wherein separating, at least partially, the adhered first fabric from the stabilizing material to expose the perforated edge of the opening in the stabilizing material is progressive or incremental as the stitching proceeds.

9. The method of claim 1, wherein the fabric pattern piece comprises a quilt block unit.

10. The method of claim 1, wherein the stitching in the method is computer implemented, and wherein stitching using the machine a perforated guide-line in the stabilizing material outlining a shape to be opened therein, comprises transmitting a digitized software program or file that provides sewing pattern instructions to said stitching machine, and activating the digitized file to perform said stitching.

11. The method of claim 10, wherein stitching, with thread and using the machine, a seam adjacent to but not including the edge of the stabilizer material defining the opening therein, the seam joining the folded adhered joining seam margin of the first piece of fabric to the second piece of fabric to produce a fabric pattern piece having a front and a back side, comprises activating the digitized file to perform said stitching.

12. The method of claim 1, wherein the holding member comprises an embroider hoop or the like, and wherein the stitching machine comprises a sewing or embroidery machine.

13. A method of assembling a quilt block pattern unit comprising:

securing a stabilizing material in an embroidery hoop and attaching said embroidery hoop to an embroidery machine;

transmitting a digitized embroidery file that provides sewing pattern instructions to said embroidery machine;

activating the digitized embroidery file so that the embroidery machine stitches a cutting guide into the stabilizing material defining the outside edges of a quilt pattern piece and a perforated guide-line in the stabilizing material outlining a shape to be opened therein, wherein the shape comprises a curve;

detaching the stabilizing material from the pre-determined opening along the perforated guide-line;

adhering a first piece of fabric which is larger than the outside edges of the quilt pattern piece to the stabilizing material using a temporary adhesive;

cutting the adhered first fabric piece inside the pre-determined opening following the edge but maintaining a margin suitable for formation of a joining seam;

further cutting the adhered fabric orthogonally to the pre-determined opening edge at short intervals (e.g., between about 1/16" and about 1"), to provide for tension relief when the fabric is later folded;

folding the margin down through the pre-determined opening and back onto the reverse side of the stabilizer material;

adhering the fabric to the reverse side of the stabilizer using a temporary adhesive;

further applying an external adhesive to the margin which has been folded back (e.g., wherein the adhesive is applied by spraying, brushing or wiping on the fabric margin, and wherein the adhesive comprises a permanent or temporary adhesive) and laying a second piece of fabric on top of the first fabric margin which is then secured by the applied adhesive; and activating the digitized embroidery file so that the embroidery machine stitches a seam which joins the two pieces of fabric around the edge of the pre-determined opening in the stabilizer material to produce a quilt block pattern having a front and a back side, wherein the stitching of the seam is not visible on the front side thereof.

14. The method of claim 13, comprising, after stitching the seam joining the two pieces of fabric, at least one of: removing, at least in part, the stabilizing material from between the first and second pieces of fabric; and cutting away at least a portion of the second piece of fabric that extends beyond the outside edge of the folded seam margin of the first piece of fabric.

15. The method of claim 13, wherein the temporary adhesive comprises at least one of a heat fusible coating on the stabilizing material, heat fusible wax, and an artificial coating.

16. The method of claim 13, wherein at least one temporary adhesive may be applied externally by spraying, brushing or wiping on the stabilizer surface.

17. The method of claim 13, wherein the stabilizer is termed waxed paper or freezer paper, and is coated on at least one side with heat fusible wax or an artificial coating.

18. The method of claim 13, wherein the external adhesive applied to the seam margin comprises a water soluble adhesive.

19. A computerized embroidery machine sewing instruction file product in a computer readable medium for use with a computerized embroidery machine, the computer embroidery machine sewing instruction file comprising:

instructions for sewing stitches to place stitching, placement and cutting guides for a quilt pattern piece in a substrate held in an embroidery hoop;

instructions to sew stitches which form at least one guide which demarcates the edge of an opening which contains at least one line element having an arbitrary shape which is defined by the design contained in the computer embroidery machine instruction file; and instructions for sewing a joining seam between two pieces of fabric such that the seam is only visible from one side.

* * * * *